US008561803B2

(12) United States Patent
Fallon

(10) Patent No.: US 8,561,803 B2
(45) Date of Patent: Oct. 22, 2013

(54) METHOD AND APPARATUSES FOR SCREENING

(75) Inventor: Thomas M. Fallon, East Aurora, NY (US)

(73) Assignee: Derrick Corporation, Buffalo, NY (US)

( * ) Notice: Subject to any disclaimer, the term of this patent is extended or adjusted under 35 U.S.C. 154(b) by 230 days.

(21) Appl. No.: 12/459,708

(22) Filed: Jul. 7, 2009

(65) Prior Publication Data

US 2010/0000914 A1 Jan. 7, 2010

Related U.S. Application Data

(60) Provisional application No. 61/134,168, filed on Jul. 7, 2008.

(51) Int. Cl.
*B07B 1/42* (2006.01)

(52) U.S. Cl.
USPC ..... 209/365.4; 209/405

(58) Field of Classification Search
USPC ..... 209/313, 357, 365.4, 405, 323
See application file for complete search history.

(56) References Cited

U.S. PATENT DOCUMENTS

| | | | | |
|---|---|---|---|---|
| 2,951,581 | A | 9/1960 | Long et al. | |
| 3,317,041 | A | 5/1967 | Century | |
| 3,796,299 | A | 3/1974 | Musschoot | |
| 4,315,817 | A | 2/1982 | Popper | |
| 5,193,689 | A * | 3/1993 | Hoppe | 209/323 |
| 5,615,776 | A * | 4/1997 | Bjorklund et al. | 209/403 |
| 5,896,998 | A * | 4/1999 | Bjorklund et al. | 209/326 |
| 6,107,715 | A | 8/2000 | Patterson et al. | |
| 6,415,913 | B2 | 7/2002 | Sleppy et al. | |
| 6,679,385 | B2 * | 1/2004 | Suter et al. | 209/367 |
| 2008/0047877 | A1 * | 2/2008 | Freissle et al. | 209/405 |
| 2008/0105598 | A1 * | 5/2008 | Fisher et al. | 209/402 |

OTHER PUBLICATIONS

Ergin, Transient Response of Non-Linear Spring-Mass Systems, California Institute of Technology, thesis [online], [retrieved on May 20, 1998]. Retrieved from the Internet:<URL:http://etd.caltech.edu/etd/available/etd-12032003-092544/unrestricted/Ergin_ei_1954.pdf>, entire document.

* cited by examiner

*Primary Examiner* — Joseph C Rodriguez
*Assistant Examiner* — Kalyanavenkateshware Kumar
(74) *Attorney, Agent, or Firm* — Jason P. Mueller; Adams and Reese, LLP

(57) ABSTRACT

A method and apparatus are disclosed for screening materials. A vibratory screening machine includes a first frame and a second frame. The second frame is attached to the first frame by elastomeric mountings. A vibratory motor is configured to vibrate the first frame and the second frame. An attachment arrangement is configured to secure a replaceable screen assembly to the first frame. The replaceable screen assembly is in contact with the second frame such that the second frame excites the replaceable screen assembly.

22 Claims, 7 Drawing Sheets

METHOD AND APPARATUSES FOR SCREENING

CROSS-REFERENCE TO RELATED APPLICATIONS

The present application claims the benefit of U.S. Provisional Patent Application Ser. No. 61/134,168 filed Jul. 7, 2008, which is expressly incorporated herein in its entirety by reference thereto.

FIELD

The present invention relates generally to material screening. More particularly, the present invention relates to a method and apparatuses for screening.

BACKGROUND

Material screening includes the use of vibratory screening machines. Vibratory screening machines provide the capability to excite an installed screen such that materials placed upon the screen may be separated to a desired level. Vibratory screening machines have several drawbacks that limit their productivity and use, including limited capacity and efficiency. It is desirous to screen a maximum amount of material in a given amount of space, e.g., the footprint of the machine, and to minimize blinding issues such a plugging of screening surfaces.

SUMMARY

Among other benefits, the present invention provides for increased screening capacity and efficiency. According to an example embodiment of the present invention, a vibratory screening machine is provided that includes: a first frame; a second frame attached to the first frame by elastomeric mountings; a vibratory motor configured to vibrate the first frame and the second frame; at least one replaceable screen assembly; and at least one attachment arrangement configured to secure the at least one replaceable screen assembly to the first frame and place the at least one replaceable screen assembly in contact with the second frame, wherein the second frame excites the at least one replaceable screen assembly.

DETAILED DESCRIPTION

Figure 1:
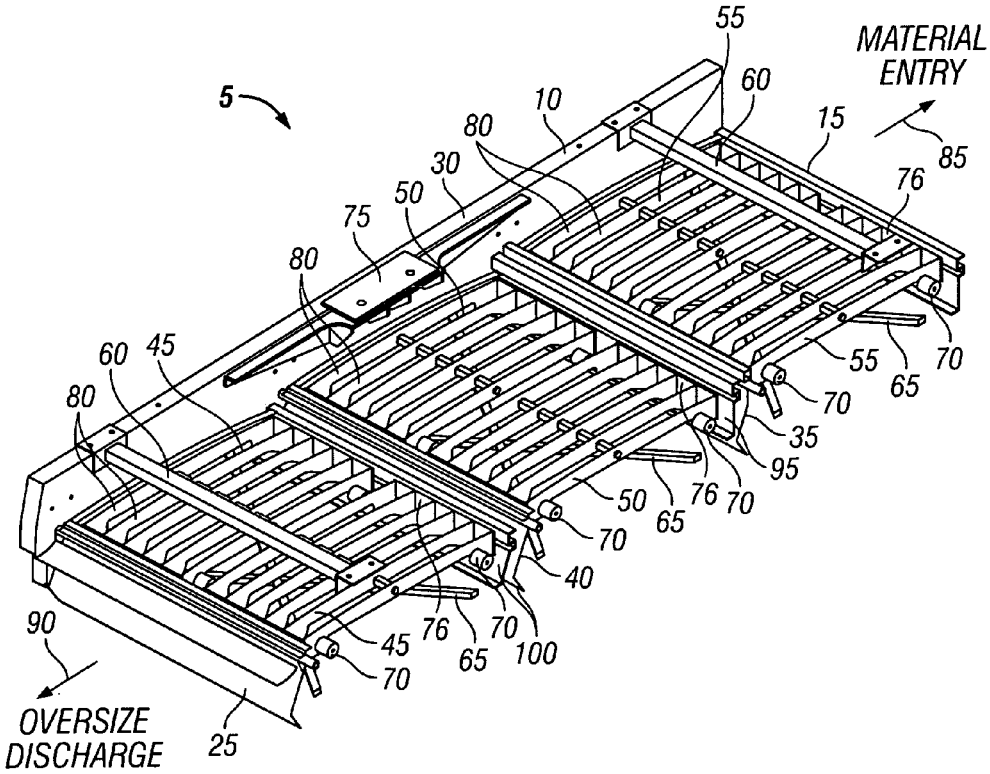
FIG. 1 is an isometric view of a section of a vibratory screening machine according to an exemplary embodiment of the present invention.

Like reference characters denote like parts in the drawings.

FIGS. 1 to 5 show a vibratory screening machine 5 according to an exemplary embodiment of the present invention.

FIG. 1 shows a section of vibratory screening machine 5. The vibratory screening machine 5 includes a first frame 10. First frame 10 includes a rear bulkhead 15, a front bulkhead 25, a first side plate member 30, and a second side plate member 20 (see FIG. 3), and a plurality of torque tubes 60 and a plurality of cross braces 65 to provide structural stability to the first frame 10. Second frames 45, third frames 50, and fourth frames 55 may be attached to the first frame by elastomeric mountings 70. A vibratory motor 115 (see FIG. 4) may be configured to vibrate the first frame 10, the second frames 45, the third frames 50, and the fourth frames 55. Vibratory motor 115 may be attached to the first frame 10 via a motor mount 75. The vibratory screening machine 5 shown in FIG. 1 is configured such that three replaceable screen assemblies 120 (see FIGS. 4 and 5) may be secured to the first frame 10, whereby each of the screen assemblies will be place in contact with second frames 45, third frames 50, and fourth frames 55, respectively, such that second frames 45, third frames 50, and fourth frames 55 excite each of the respective screen assemblies they contact. Elastomeric mountings 70 attach second frames 45, third frames 50, and fourth frames 55 to first frame 10 and may be configured such that these frames vibrate at a different frequency from first frame 10. These vibrations reduce potential blind problems and increase the efficiency of the vibrating machine. See discussion below regarding FIGS. 7 and 8.

Vibratory screening machine 5 is subdivided into three "stages" by a first step bulkhead 35, a first fixed bulkhead 95, a second step bulkhead 40, and a second fixed bulkhead 100, wherein each stage contains one of the second frames 45, the third frames 50, and the fourth frames 55. Each of the second frames 45, third frames 50, and fourth frames 55 further includes first interior side frame members 76, second interior side frame members 125 (see FIG. 3), fixed cross members 135, and a plurality of cross members 80 attached between the first interior side frame members 76 and second interior side frame members 125 (see FIG. 3). Each fixed cross member 101 is attached to the second frames 45, third frames 50, and fourth frames 55 via a plurality of elastomeric mountings 70, and to the first frame 10 via the rear bulkhead 15 and the first step bulkhead 35, the first fixed bulkhead 95 and the second step bulkhead 40, and the second fixed bulkhead 100 and the front bulkhead 25, respectively. The fixed cross members 101, thus form part of first frame 10 and separate second frames 45, third frames 50 and fourth frames 55 into two separate frame pieces each. See FIG. 3 where elastomeric mountings 70 separate second frames 45, third frames 50 and fourth frames 50 into two separate frame pieces 45*a* and 45*b*, 50*a* and 50*b* and 55*a* and 55*b*. As shown, the first and second interior side frame members 76 and 125 are not attached to the first frame 10. They may, however, be attached to first frame 10 in a manner so that they can vibrate relative to the first frame 10, e.g., via elastomeric mountings or another connection mechanism. The exemplary embodiment of the present invention illustrated by FIG. 1 is configured such that unscreened material enters the vibratory screening machine 5 at the feeder end 85 of the machine and, due to the vibrations induced by the vibratory motor 115 attached to the first frame 10 at the motor mount 75, migrates across the three replaceable screen assemblies 120. The three replaceable screen assemblies are in contact with and excited by the second frames 45, third frames 50, and fourth frames 55 such that oversized particles emerge from the discharge end 90 of the vibratory screening machine 5, and other particles fall through one of the three replaceable screen assemblies 120. In this manner three stages of screening may be provided. As discussed below, the configuration and attachment of the second, third, and fourth frames, through elastomeric mountings or another similar connection apparatus may be configured such that the second, third, and fourth frames to vibrate at their own frequencies. Although three stages (and their associated frames and screens) are provided for in the exemplary embodiment shown in FIG. 1, additional stages and configurations may be provided, including multiple additional stages and multiple additional frames per stage. Additionally, various configurations of elastomeric mounting may be provided such that a specific frequency may be imparted to the different frames as desired for a particular screening application.

Figure 2:
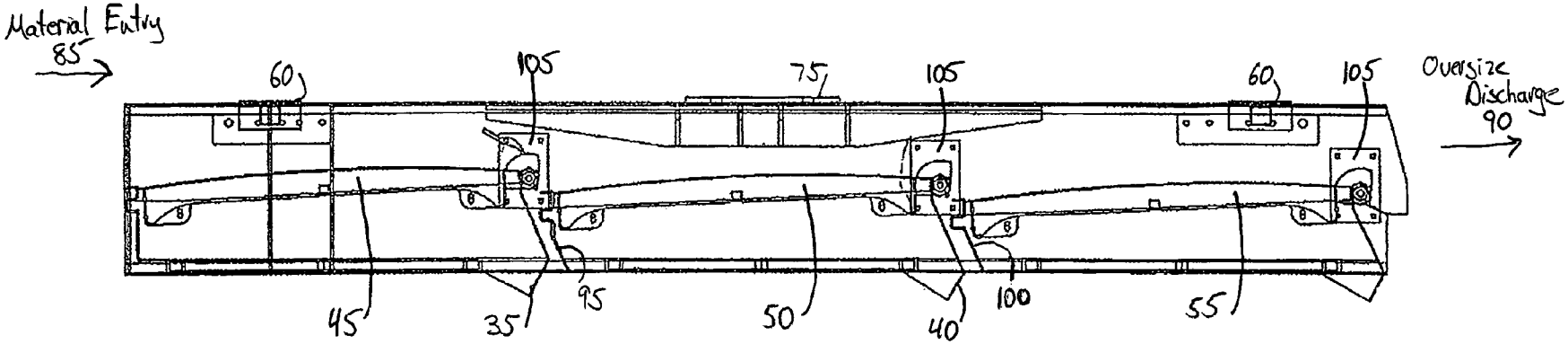
FIG. 2 is a sectional view of the vibratory screening machine shown in FIG. 1.

FIG. 2 shows a sectional view of vibratory screening machine 5. As shown in FIG. 2, second frames 45, third frames 50, and fourth frames 55 attach to first frame 10 (see, e.g., FIG. 3) by a plurality of elastomeric mountings 70. The first frame 10 includes a plurality of torque tubes 60 to provide structural stability to first frame 10. Three replaceable screen assemblies 120 (see FIG. 5) may be configured such that they are secured to the first frame 10 via the rear bulkhead 15 and the first step bulkhead 35, the first fixed bulkhead 95 and the second step bulkhead 40, and the second fixed bulkhead 100 and the front bulkhead 25, respectively, and one replacement screen assembly 120 is supported from below by each of the second frames 45, third frames 50, and fourth frames 55. Further, a screen tensioner device 105 located at the point of attachment of each replaceable screen assembly 120 (see FIG. 5) to the first frame 10 at the first step bulkhead 35, the second step bulkhead 40, and the front bulkhead 25 may be configured to allow for the adjustment of the total tension of each replaceable screen assembly 120. Screen tensioner device 105 may include a ratchet type mechanism or any other suitable arrangement for tensioning the replaceable screen assemblies 120. Screen assemblies 120 may be tensioned such that they are stretched over their respective frames 45, 50 and 55. As shown in FIG. 2, unscreened material enters the vibratory screening machine 5 at the feeder end 85 of the machine and, due to the vibrations induced by the vibratory motor 115 (see FIG. 4) attached to the first frame 10, migrates across the three replaceable screen assemblies 120 as a result of vibrations produced by the second frames 45, third frames 50, and fourth frames 55 such that oversized particles emerge from the discharge end 90 of the vibratory screening machine 5, and other particles fall through one of the three replaceable screen assemblies 120. In this exemplary embodiment three stages of screening are provided. As previously discussed, the configuration and attachment of the second, third, and fourth frames, through elastomeric mountings or another similar connection apparatus may be configured to cause the second, third, and fourth frames to vibrate at desired frequencies.

Figure 3:
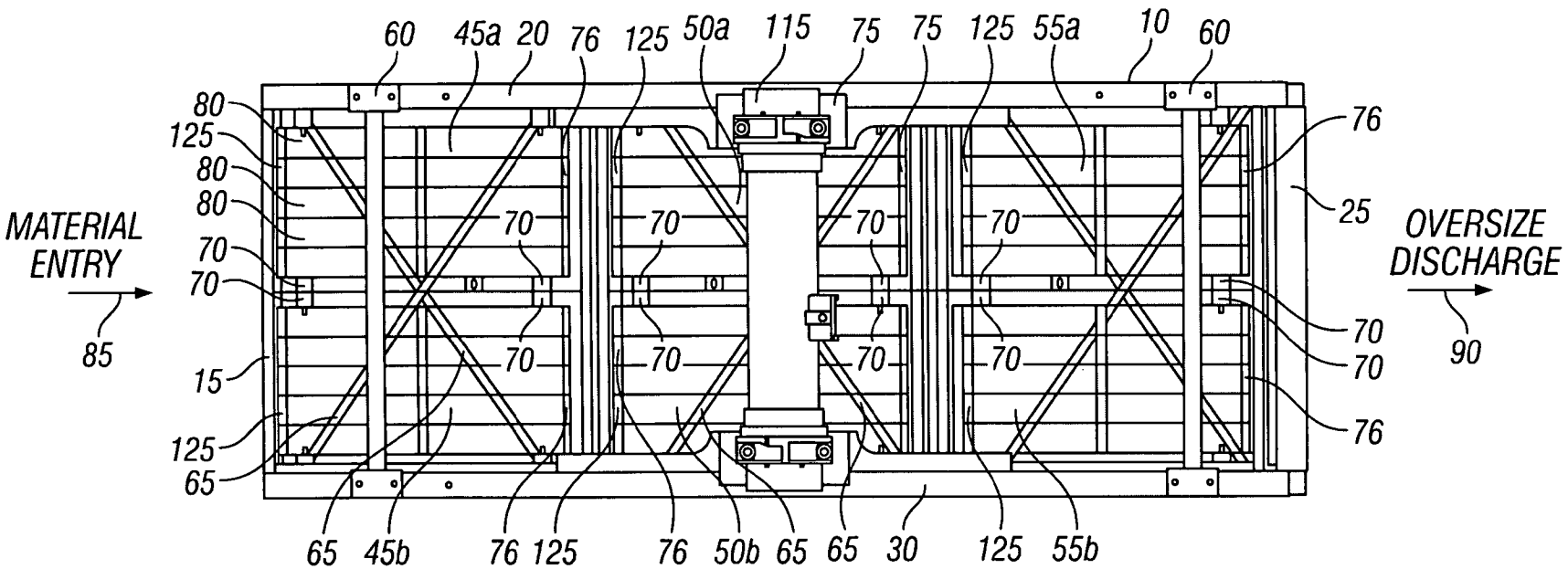
FIG. 3 is a plan view of the vibratory screening machine shown in FIG. 1.

FIG. 3 shows a plan view of vibratory screening machine 5. As previously discussed, vibratory screening machine 5 includes first frame 10 to which second frames 45*a* and 45*b*, third frames 50*a* and 50*b*, and fourth frames 55*a* and 55*b* are attached by a plurality of elastomeric mountings 70. The first frame includes a rear bulkhead 15, a front bulkhead 25, a first side plate member 30, a second side plate member 20 and fixed cross members 101. Fixed cross members 101 separate second frames 45*a* from 45*b*, third frames 50*a* from 50*b* and fourth frames 55*a* from 55*b*.

Figure 4:
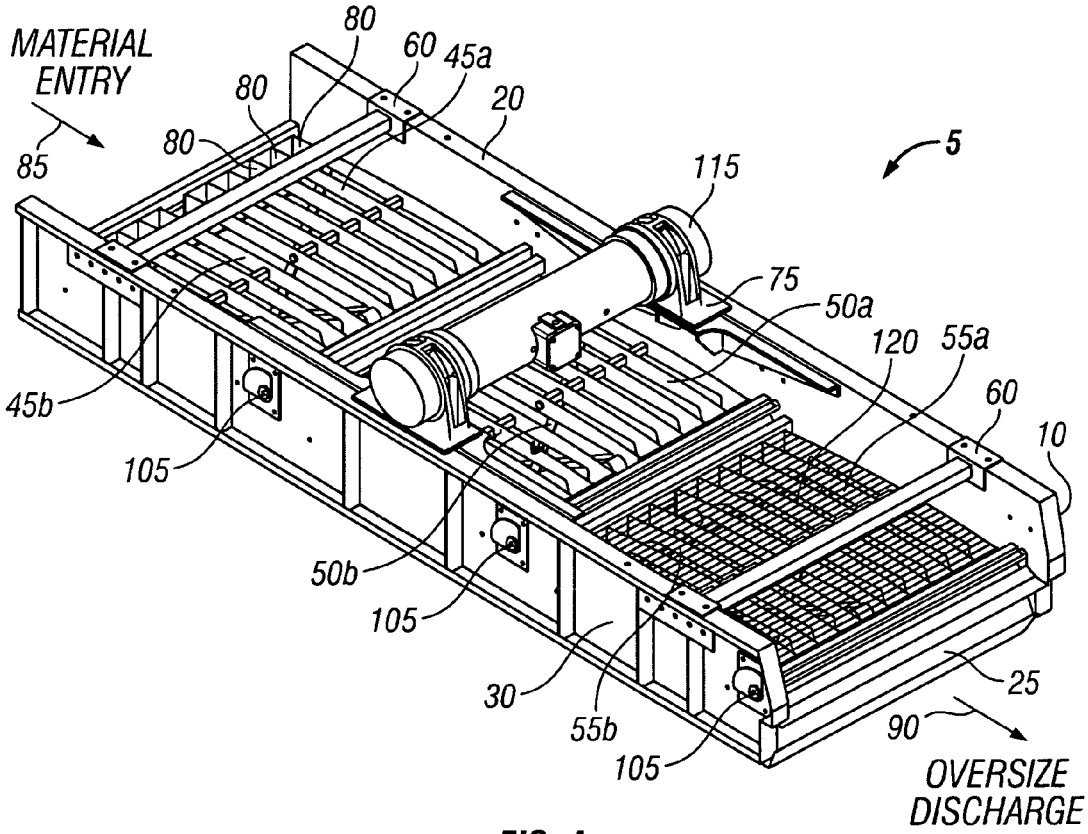
FIG. 4 is an isometric view of the vibratory screening machine shown in FIG. 1.

FIG. 4 shows an isometric view of vibratory screening machine 5. Replacement screen assembly 120 is shown in place and fixed to the first frame 10 at the second fixed bulkhead 100 (see FIG. 2) and the front bulkhead 25 and supported from below by the fourth frames 55*a* and 55*b*. Further, the screen tensioner device 105 is located at the point of attachment of replacement screen assembly 120 to the front bulkhead 25 may be configured to allow for the adjustment of the total tension of replaceable screen assembly 120. Additional replaceable screen assemblies along with their respective tensioning devices may be provided in each of the screening sections or stages.

Figure 5:
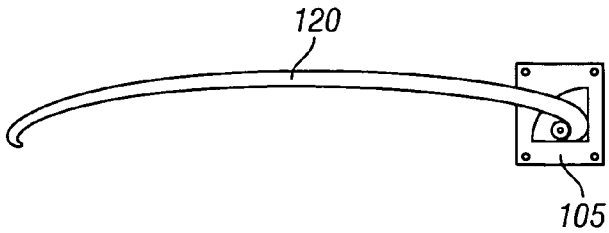
FIG. 5 is a side of a replaceable screen assembly according to an exemplary embodiment of the present invention.

FIG. 5 shows a side view of replacement screen assembly 120 and tensioner device 105. The replacement screen assembly 120 may be configured such that one end is connected to a screen tensioner device 105 (which is configured to allow for the adjustment of the total tension of the replaceable screen device 120) and the other end is secured to first frame 10. Each replacement screen device 120 may be configured to be secured to first frame 10 and supported from below by second frames 45, third frames 50, or fourth frames 55.

Figure 6:
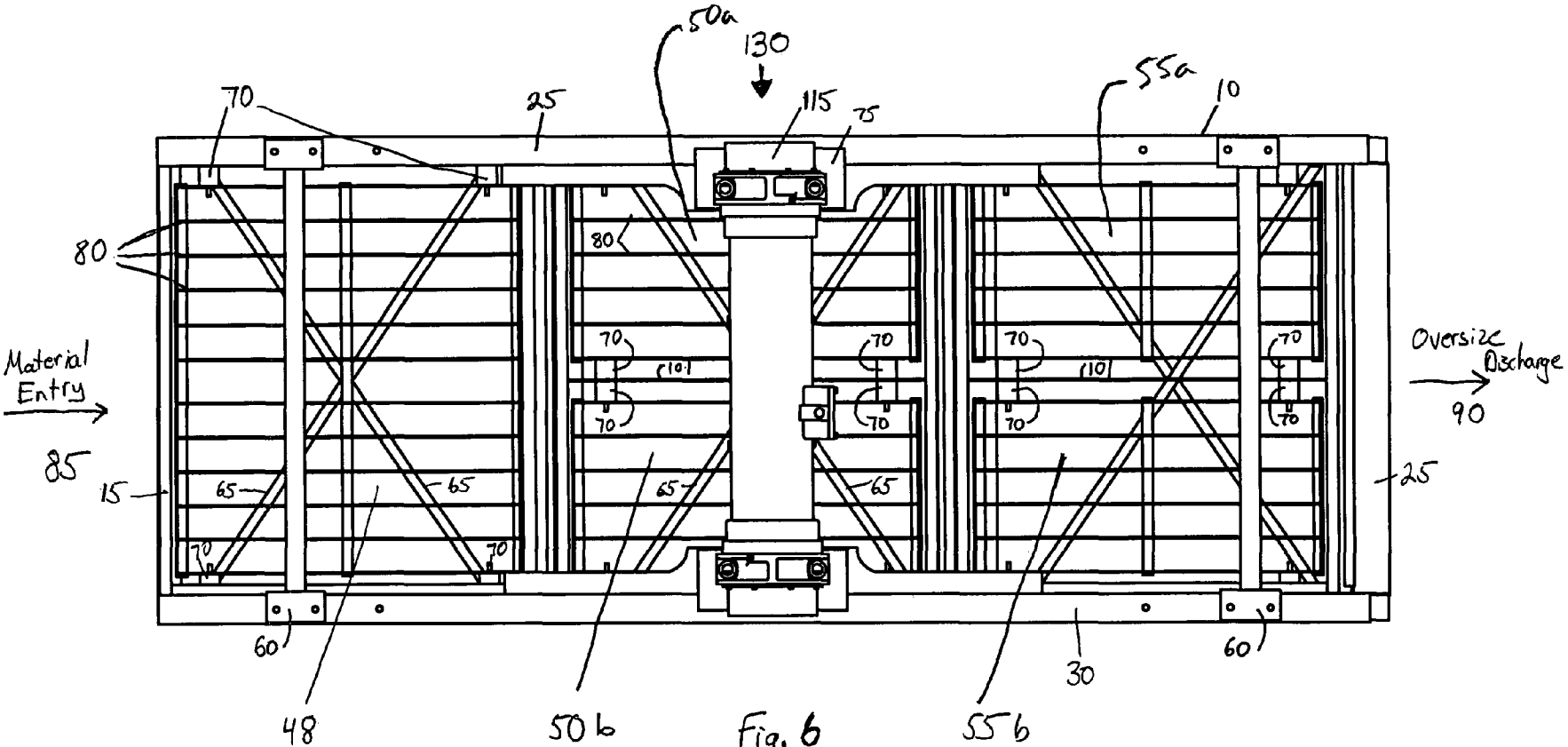
FIG. 6 is a plan view of a vibratory screening machine according to an exemplary embodiment of the present invention.

FIG. 6 shows a plan view of a vibratory screening machine 130 according to an exemplary embodiment of the present invention. As shown in FIG. 6, different configurations of secondary frames may be attached to first frame 10 by elastomeric mountings 70 such that various secondary framing options, or "deck options," are provided. As shown a plurality of additional elastomeric mountings 70 are attached between fixed cross members 101 which form part of first frame 10. In the particular embodiments of the present invention illustrated in FIGS. 1, 3, and 4, each of the second frames 45*a* and 45*b*, third frames 50*a* and 50*b*, and fourth frames 55*a* and 55*b* are configured in an identical first deck option with a central fixed cross member 100 attached to the secondary frames 45, third frames 50, and fourth frames 55 via a plurality of elastomeric mountings 70, and to the first frame 10 via the rear bulkhead 15 and the first step bulkhead 35, the first fixed bulkhead 95 and the second step bulkhead 40, and the second fixed bulkhead 100 and the front bulkhead 25, respectively. In the particular embodiment of the present invention illustrated in FIG. 6, a second deck option is demonstrated by the secondary frame 48, wherein the secondary frame 48 is attached to the first frame 10 by four elastomeric mountings, and no fixed cross member 100 or additional elastomeric mountings are present. As illustrated in FIG. 6, the third frames 50*a* and 50*b* and fourth frames 55*a* and 55*b* share the first deck option previously illustrated in FIGS. 1, 3, and 4. While only two distinct deck options have been in the exemplary embodiments illustrated in FIGS. 1, 3, 4, and 6, additional deck options configurations may be provided.

Figure 7:
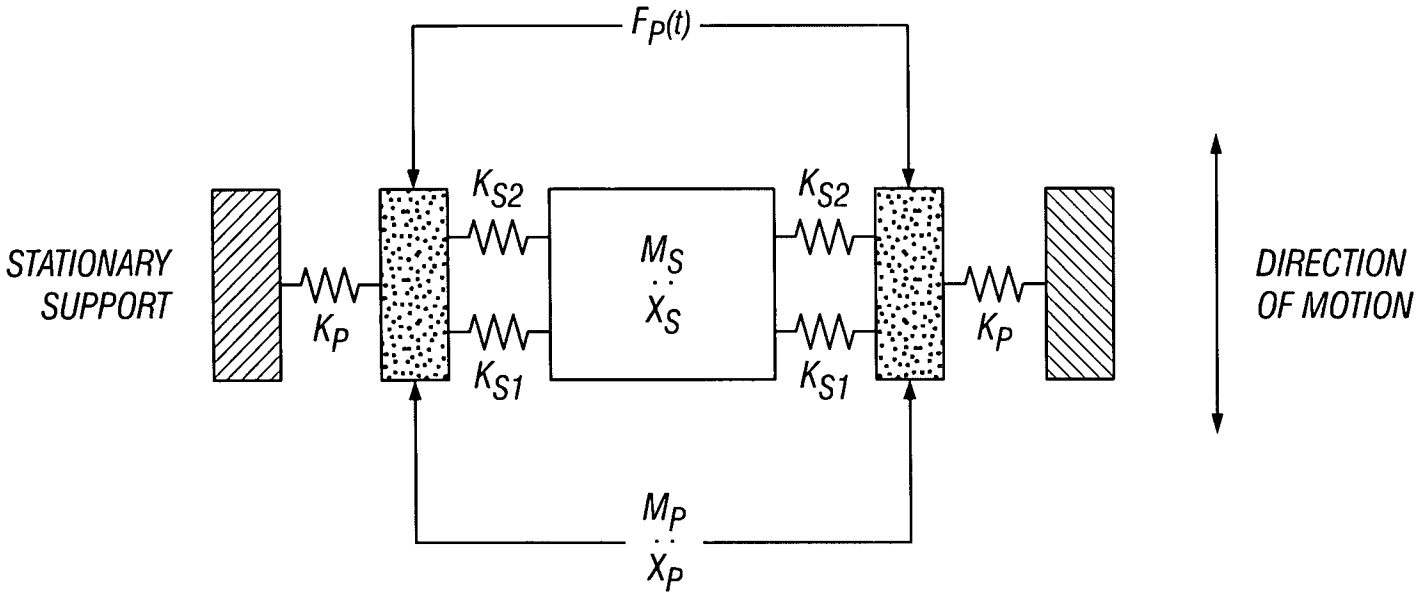
FIG. 7 illustrates a mathematical model of a vibratory screening machine as expressed as a system of springs and dampened masses, according to an exemplary embodiment of the present invention.
Figure 8:
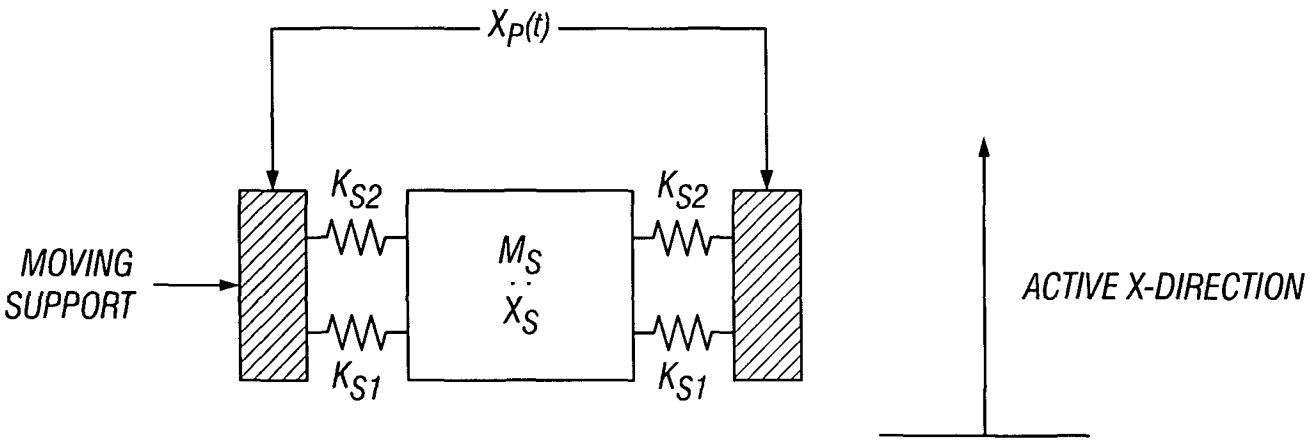
FIG. 8 illustrates a particular subsystem of the mathematical model illustrated in FIG. 7.

FIGS. 7 and 8 show a mathematical model of a vibratory screening machine as expressed as a spring and dampened mass system according to an exemplary embodiment of the present invention. This model can be implemented with the exemplary embodiments discussed herein. Considering the system illustrated in FIG. 7, let the total mass of the primary system be Mp, the exterior grounded spring be Kp and the system driving force be Fp(t). The equation of motion for the system with a primary damping factor of Cp can be written as follows:

$$(M_p+M_S)\ddot{X}_p+C_p\dot{X}_p+K_pX=F_p(t)$$

Where $\ddot{X}p$ is the acceleration, $\dot{X}p$ is the velocity, and the displacement of the system is non-linear, the general solution can be written as:

$$X_p=G(F_p(t),(M_p+M_S,C_p)$$

The displacement Xp(t) then acts as an input to the subsystem illustrated in FIG. 8 with mass Ms and springs Ks1 and Ks2, where Ks1 is fixed to the structure at all times and Ks2 is the screen to the subsystem.

There are two possible ways in which the mass Ms interacts with the two sets of non-linear springs Ks1 and Ks2. Referring to FIG. 8, when the mass Ms is moving in the established direction and is in contact with the screen, the varying stiffness Ks2 as a function of displacement comes into play. The equation of motion of the subsystem illustrated in FIG. 8 can be written as follows:

$$M_S\ddot{X}_S+C_S\dot{X}_S+(K_{S1}+K_{S2})X_S=X_p(t)$$

When the mass Ms is no longer in contact with the screen, the equation of motion of the subsystem illustrated in FIG. 5 can be written as follows:

$$M_S\ddot{X}_S+C_S\dot{X}_S+K_{S1}X_S=X_p(t)$$

The result of the motion of the subsystem is that the acceleration Xs will have different characteristics during the displacement cycle described by Xp(t).

According to another exemplary embodiment of the present invention a vibratory screening machine may be provide that includes a first frame; a second frame attached to the first frame by elastomeric mountings; a first vibratory motor; a second vibratory motor configured to run in an opposite direction of the first vibratory motor, the first vibratory motor configured to vibrate at least one of the first frame and the second frame, the second vibratory motor configured to vibrate at least one of the first frame and the second frame; at least one replaceable screen assembly; and at least one attachment arrangement configured to secure the at least one replaceable screen assembly to the first frame and place the at least one replaceable screen assembly in contact with the second frame, wherein the second frame excites the at least one replaceable screen assembly.

According to another exemplary embodiment of the present invention a method of screening materials may be provided that includes screening materials using a vibratory screening machine as provided in the above exemplary embodiments. The vibratory screening machine may include: a first frame; a second frame attached to the first frame by elastomeric mountings; a vibratory motor configured to vibrate the first frame and the second frame; at least one replaceable screen assembly; and at least one attachment arrangement configured to secure the at least one replaceable screen assembly to the first frame, and place the at least one replaceable screen assembly in contact with the second frame, wherein the second frame excites the at least one replaceable screen assembly. According to another exemplary embodiment of the present invention a method of screening materials may include screening materials using a vibratory screening machine where the vibratory screening machine may include: a first frame; a second frame attached to the first frame by elastomeric mountings; a first vibratory motor; a second vibratory motor configured to run in an opposite direction of the first vibratory motor, the first vibratory motor configured to vibrate at least one of the first frame and the second frame, the second vibratory motor configured to vibrate at least one of the first frame and the second frame; at least one replaceable screen assembly; and at least one attachment arrangement configured to secure the at least one replaceable screen assembly to the first frame and place the at least one replaceable screen assembly in contact with the second frame, wherein the second frame excites the at least one replaceable screen assembly.

While a number of example embodiments of the present invention have been described, it is understood that these example embodiments are illustrative only, and not restrictive, and that many modifications would be apparent to those of ordinary skill in the art. Further still, any steps described herein may be carried out in any desired order, and any desired steps may be added or deleted.

What is claimed is:

1. A vibratory screening machine, comprising:

a first frame;

a second frame attached to the first frame by elastomeric mountings;

a vibratory motor configured to vibrate the first frame;

at least one replaceable screen assembly; and at least one attachment arrangement configured to secure the at least one replaceable screen assembly to the first frame and place the at least one replaceable screen assembly in contact with the second frame, and wherein the at least one replaceable screen assembly is not secured to the second frame, and wherein the second frame excites the at least one replaceable screen assembly.

2. The vibratory screening machine of claim 1, wherein the elastomeric mountings are configured such that the second frame vibrates at a different frequency than the first frame.

3. The vibratory screening machine of claim 1, further comprising a third frame attached to the first frame by elastomeric mountings, at least one additional replacement screen assembly and at least one additional attachment arrangement configured to secure the at least one additional replaceable screen assembly to the first frame, and supported from below the at least one additional screen assembly by the third frame, wherein the at least one additional replaceable screen assembly is not secured to the third frame.

4. The vibratory screening machine of claim 1, wherein the second frame includes a deck having a first interior side frame member, a second interior side frame member and cross members between the first and second interior side frame members.

5. The vibratory screening machine of claim 2, wherein the first frame includes a first side plate member, a second side plate member, a first bulk head member, a second bulk head member and a third bulk head member, the first, second and third bulk head members disposed between the first and second side plate members and spaced apart to accommodate the second and third frames, wherein the second and third frames provide first and second stage screening areas.

6. The vibratory screening machine of claim 1, wherein the first frame includes a first side plate member, a second side plate member and at least one bulk head member disposed between the first and second side plate members.

7. A method of screening, comprising: screening materials using a vibratory screening machine, the vibratory screening machine comprising: a first frame; a second frame attached to the first frame by elastomeric mountings; a vibratory motor configured to vibrate the first frame; at least one replaceable screen assembly; and at least one attachment arrangement configured to secure the at least one replaceable screen assembly to the first frame, wherein the at least one screen assembly is in contact with the second frame and wherein the at least one replaceable screen assembly is not secured to the second frame.

8. A vibratory screening machine, comprising:

a first frame;

a second frame attached to the first frame by elastomeric mountings;

a first vibratory motor;

a second vibratory motor configured to run in an opposite direction of the first vibratory motor, the first and second vibratory motors configured to vibrate the first frame;

at least one replaceable screen assembly; and at least one attachment arrangement configured to secure the at least one replaceable screen assembly to the first frame and place the at least one replaceable screen assembly in contact with the second frame, wherein the at least one replaceable screen assembly is not secured to the second frame, and wherein the second frame excites the at least one replaceable screen assembly.

9. The vibratory screening machine of claim 8, further comprising a third frame attached to the first frame by elastomeric mountings, at least one additional replacement screen assembly and at least one additional attachment arrangement configured to secure the at least one additional replaceable screen assembly to the first frame and supported from below the at least one additional screen assembly by the third frame and wherein the at least one additional replacement screen assembly is not secured to the third frame.

10. The vibratory screening machine of claim 8, wherein the second frame includes a deck having a first interior side frame member, a second interior side frame member and cross members between the first and second interior side frame members.

11. The vibratory screening machine of claim 8, wherein the first frame includes a first side plate member, a second side plate member and at least one bulk head member disposed between the first and second side plate members.

12. A method of screening, comprising: screening materials using a vibratory screening machine, the vibratory screening machine comprising: a first frame; a second frame attached to the first frame by elastomeric mountings; a first vibratory motor; a second vibratory motor configured to run in an opposite direction of the first vibratory motor, the first and second vibratory motors configured to vibrate the first frame; at least one replaceable screen assembly; and at least one attachment arrangement configured to secure the at least one replaceable screen assembly to the first frame wherein the at least one screen assembly is in contact with the second frame and wherein the second frame excites the at least one replaceable screen assembly and wherein the at least one replaceable screen assembly is not secured to the second frame.

13. A vibratory screening machine, comprising:

a first frame;

a second frame attached to the first frame by elastomeric mountings;

a vibratory motor configured to vibrate the first frame;

at least one replaceable screen assembly; and at least one attachment arrangement configured to secure the at least one replaceable screen assembly to the first frame only and place the at least one replaceable screen assembly in contact with the second frame, wherein the second frame excites the at least one replaceable screen assembly.

14. The vibratory screening machine of claim 13, wherein the elastomeric mountings are configured such that the second frame vibrates at a different frequency than the first frame.

15. The vibratory screening machine of claim 13, further comprising a third frame attached to the first frame by elastomeric mountings, at least one additional replacement screen assembly and at least one additional attachment arrangement configured to secure the at least one additional replaceable screen assembly to the first frame only, and supported from below the at least one additional screen assembly by the third frame.

16. The vibratory screening machine of claim 13, wherein the second frame includes a deck having a first interior side frame member, a second interior side frame member and cross members between the first and second interior side frame members.

17. The vibratory screening machine of claim 14, wherein the first frame includes a first side plate member, a second side plate member, a first bulk head member, a second bulk head member and a third bulk head member, the first, second and third bulk head members disposed between the first and second side plate members and spaced apart to accommodate the second and third frames, wherein the second and third frames provide first and second stage screening areas.

18. The vibratory screening machine of claim 13, wherein the first frame includes a first side plate member, a second side plate member and at least one bulk head member disposed between the first and second side plate members.

19. A vibratory screening machine, comprising:

a first frame;

a second frame attached to the first frame by elastomeric mountings;

a vibratory motor configured to vibrate the first frame;

at least one replaceable screen assembly; and at least one attachment arrangement configured to secure the at least one replaceable screen assembly to the first frame only and place the at least one replaceable screen assembly in contact with the second frame, wherein the second frame excites the at least one replaceable screen assembly; and wherein the elastomeric mountings are configured such that the second frame vibrates at a different frequency than the first frame.

20. The vibratory screening machine of claim 19, further comprising a third frame attached to the first frame by elastomeric mountings, at least one additional replacement screen assembly and at least one additional attachment arrangement configured to secure the at least one additional replaceable screen assembly to the first frame only, and supported from below the at least one additional screen assembly by the third frame.

21. The vibratory screening machine of claim 20, wherein the elastomeric mountings attaching the third frame to the first frame are configured such that the third frame vibrates at a different frequency than the first frame.

22. The vibratory screening machine of claim 20, wherein the elastomeric mountings attaching the third frame to the first frame are configured such that the third frame vibrates at a different frequency than the second frame.

* * * * *